US009345345B2

(12) United States Patent
Kula

(10) Patent No.: US 9,345,345 B2
(45) Date of Patent: May 24, 2016

(54) CORRUGATED DISPLAY RACK WITH CANTILEVERED SHELVES

(71) Applicant: INTERNATIONAL PAPER COMPANY, Memphis, TN (US)

(72) Inventor: Gregory James Kula, Huntley, IL (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 204 days.

(21) Appl. No.: 14/068,345

(22) Filed: Oct. 31, 2013

(65) Prior Publication Data

US 2015/0114920 A1 Apr. 30, 2015

(51) Int. Cl.
*A47F 5/11* (2006.01)
*A47B 96/02* (2006.01)

(52) U.S. Cl.
CPC ..... *A47F 5/116* (2013.01); *A47B 96/027* (2013.01)

(58) Field of Classification Search
CPC .... A47B 43/00; A47B 43/03; A47B 47/0075; A47B 47/042; A47B 47/06; A47B 96/027; A47F 5/11; A47F 5/112; A47F 5/114; A47F 5/116
USPC ..... 211/132.1, 135; 312/258, 259; 248/220.22
See application file for complete search history.

(56) References Cited

U.S. PATENT DOCUMENTS

| | | | | | |
|---|---|---|---|---|---|
| 172,513 | A * | 1/1876 | Smith | 312/238 |
| 175,308 | A * | 3/1876 | Van Wie | 312/238 |
| 497,975 | A * | 5/1893 | Downer | 312/238 |
| 1,597,834 | A * | 8/1926 | Scudder | 108/34 |
| 1,654,409 | A * | 12/1927 | Browne | 108/29 |
| 1,757,398 | A * | 5/1930 | Squires | 108/42 |
| 1,852,471 | A | 4/1932 | Nelson | |
| 2,036,184 | A * | 4/1936 | Armstrong | 108/101 |
| 2,368,285 | A * | 1/1945 | Bullard | 312/238 |
| 3,008,585 | A * | 11/1961 | McNeill | 108/42 |
| 3,028,016 | A * | 4/1962 | Heftel | 108/99 |
| 3,365,258 | A * | 1/1968 | Downing | 312/140.2 |
| 3,656,611 | A | 4/1972 | Mertz | |
| 3,766,864 | A | 10/1973 | Baker et al. | |
| 3,860,305 | A | 1/1975 | Bergman | |
| 4,763,579 | A | 8/1988 | Cibulak | |
| 4,909,464 | A * | 3/1990 | Levine et al. | 248/220.22 |
| 5,669,683 | A | 9/1997 | Moss et al. | |
| 6,135,033 | A | 10/2000 | Deferrari | |
| 6,685,287 | B1 * | 2/2004 | Teel | 312/238 |
| 7,252,200 | B1 * | 8/2007 | Hester | 211/72 |
| 7,621,223 | B2 * | 11/2009 | Haghayegh | 108/42 |

FOREIGN PATENT DOCUMENTS

| | | | | |
|---|---|---|---|---|
| EP | 222130 A2 * | 5/1987 | | A47B 43/00 |
| JP | 01126915 A * | 5/1989 | | A47B 87/00 |

* cited by examiner

*Primary Examiner* — Joshua Rodden
(74) *Attorney, Agent, or Firm* — Matthew M. Eslami

(57) ABSTRACT

A display rack for displaying articles has a support frame with two walls extending at an angle from a narrow strip at the rear corner of the frame. A tubular reinforcing structure extends along the forward free edge of each wall, and aligned openings are in the strip and the reinforcing structures. A plurality of shelves having front and rear corners and opposite side corners are supported on the frame between the walls, with the rear corners engaged in respective openings in the strip and the side corners engaged in respective openings in the reinforcing structures. A forward portion of the shelves projects forwardly of the frame for greater visibility of and access to articles supported on the shelves. A reinforcing brace extends diagonally in each shelf from the rear corner to the front corner, whereby the shelves are essentially cantilevered from the frame.

13 Claims, 11 Drawing Sheets

CORRUGATED DISPLAY RACK WITH CANTILEVERED SHELVES

FIELD OF THE INVENTION

This invention relates generally to a display rack for supporting and displaying articles, and more particularly to a multi-shelf display rack made of corrugated paper, wherein a plurality of shelves are mounted on a support frame having only two walls extending at an angle to one another with the shelves mounted between them so that two sides of the shelves are exposed for enhanced visibility of and access to articles on the shelves.

BACKGROUND OF THE INVENTION

A large variety of display stands and racks with multiple shelves are known in the prior art for supporting and displaying articles, and especially for displaying articles at a point of sale. Many of these display racks are made of corrugated material, but they typically have a back wall and two side walls, so that only one edge of the shelves is exposed. Other display stands or racks are made of wood or metal and some of these have only two angularly disposed support walls so that a substantial edge portion of the shelves is exposed. Other display racks commonly used are made of metal and have only one support wall, with hooks or other support structure mounted to the wall for supporting articles for display.

The following patents are exemplary of prior art systems. U.S. Pat. No. 1,852,471 discloses a display rack system made of paperboard in which the ends of shelves are engaged in openings in the support frame, but only one edge of the shelves is exposed and they are not cantilevered. U.S. Pat. No. 3,656,611 discloses a cabinet-like display rack wherein portions of the corners of the frame are turned inwardly to provide an abutment on which four corners of the shelves are supported. U.S. Pat. No. 3,860,305 discloses a cabinet-like display rack wherein portions of the corners of the frame are turned inwardly to define guides for vertical rods that support four corners of shelves having only one edge exposed. U.S. Pat. No. 4,763,579 discloses a shelf system for mounting in a corner, wherein the shelves are cantilevered from a combination of horizontal and vertical supports at three of the corners, and two edges of the shelves are exposed. U.S. Pat. No. 5,669,683 discloses a corrugated display shelf assembly in which tabs on the back edge and ends of the shelves are engaged in slots in the support frame. Only one edge of the shelves is exposed. U.S. Pat. No. 6,135,033 discloses corrugated paper shelves folded to have triangular reinforcing structure along opposite edges. U.S. Pat. No. 7,252,200 discloses a display system with portions made of corrugated paper and wherein tabs on the display shelf trays engage in slots in the support frame. The shelf trays are made of injected plastic and are supported at three edges, with only one edge exposed. U.S. Pat. No. 3,766,864 discloses a display system in which two edges of the shelves are exposed but they are supported along all four edges and the support is accordion-folded to define a plurality of adjacent spaces in which shelves are supported.

None of the display racks or stands known to applicant is made of corrugated paper material wherein the support has only two walls joined at an angle and has openings therein for receiving three corners of reinforced shelves so that the shelves are cantilevered from the support with two edges exposed.

Accordingly, it would be desirable to provide a display rack made fully of recyclable corrugated paper material wherein the support has only two walls joined at an angle and has openings therein for receiving three corners of reinforced shelves so that the shelves are cantilevered from the support with two edges exposed.

SUMMARY OF THE INVENTION

The present invention comprises a display rack comprising a support frame with a plurality of shelves supported thereon, wherein the rack is made of fully recyclable corrugated paper material. The support frame has only two walls, said walls extending at an angle to one another from a narrow strip at the rear corner of the frame and having forward free edges with tubular reinforcing structure extending along their length. A plurality of shelves is supported on the support frame between the two walls so that a forward portion of the shelves projects beyond the walls to provide greater visibility of and access to articles supported on the shelves. The display rack is free standing and may be used alone or in combination with other like racks. For example, multiple racks may be placed back-to-back in combinations of two, three or four racks.

More specifically, the walls extend perpendicular to one another and the shelves are rectangular in shape with front, back and opposite side corners. A reinforcing brace is integrated in each shelf and extends diagonally from the shelf rear corner to the shelf front corner. Back and opposite side corners, respectively, of the shelves are engaged in openings in the strip and in the reinforcing structures, respectively, to support the shelves on the support frame. Adhesive or double face tape or other suitable fastening means preferably is engaged between the shelves and adjacent parts of the support to help secure the parts together.

Optional graphics panels may be applied to the shelves and/or to the support frame, and in the embodiment shown in FIGS. 2-4 the graphics panels applied to the shelves assist in supporting the shelves from the support frame.

Accordingly, one aspect of the present invention is directed to a display rack for supporting and displaying articles. The display rack comprises a support frame having two walls extending at an angle to one another from a narrow strip at a rear corner of the frame and each having a forward free edge with a tubular reinforcing structure along its length. A plurality of shelves is supported on the support frame between the walls. The shelves each having first support means is engaging the strip and second support means is engaging a respective reinforcing structure so that a forward portion of the shelves projects forwardly of the support frame for greater visibility of and access to articles supported on the shelves.

Another aspect of the present invention is directed to a display rack for supporting and displaying articles that comprises a support frame having two side walls extending at an angle to one another from a narrow strip at a rear corner of the support frame. Each side wall has a forward free edge along its length and the narrow strip and the forward free edges each have a plurality of openings spaced along their length. A plurality of shelves is supported on the support frame side walls, wherein each of the shelves is rectangular in shape and has a rear corner, a front corner, opposite side corners, spaced apart parallel top and bottom walls, first and second side edges extending perpendicular to one another from the shelf rear corner and defining shelf rearward side edges. Third and fourth side edges joined to respective first and second side edges and extending perpendicular to one another from the shelf front corner and defining shelf forward side edges. A reinforcing brace between the top and bottom walls extend diagonally from the rear corner of the shelf to the front corner thereof. The rear corners of the shelves is engaged in the respective openings in the strip and the side corners of the shelves is engaged in the respective openings in the forward free edges of the support frame so that the shelves are cantilevered from the support frame with the forward side edges thereof projecting forwardly of the forward free edges of the support frame side walls.

A further aspect of the invention is directed a display rack to a display rack for supporting and displaying articles that comprises a support frame made of paper material and having only two walls. The walls extend at an angle to one another from a narrow strip at a rear corner of the frame and each having a forward free edge. A plurality of openings is spaced along the narrow strip and the forward free edges. A plurality of shelves made of paper material is supported on the support frame between the walls. The shelves are rectangular in shape with rearward side edges, forward side edges, a rear corner, a front corner, and opposite side corners. The rearward side edges lying against the walls of the support frame wherein the rear corner of each of the shelf extends into a respective opening in the narrow strip and the side corners of each of the shelf extend into a the respective opening in the forward free edges of the support frame, so that the forward side edges of the shelves project forwardly of the forward free edges of the support frame for greater visibility of and access to articles supported on the shelves.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE INVENTION

Figure 1:
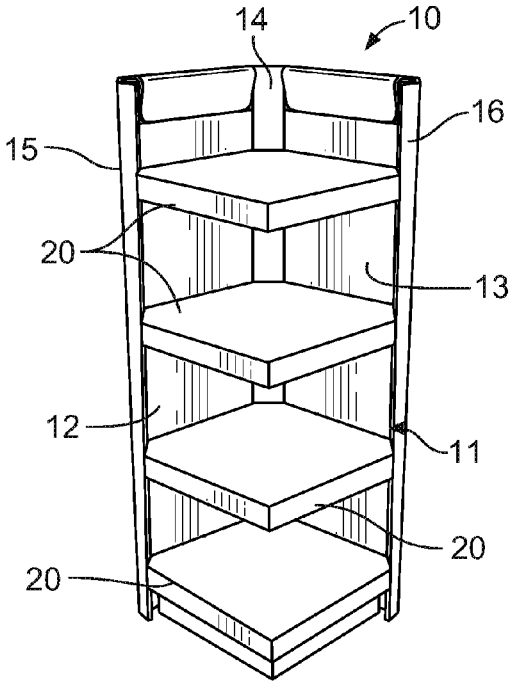
FIG. 1 is a front isometric view of a first embodiment of display rack according to the invention, shown without graphic panels.

A first form of the invention, devoid of separate graphics panels, is indicated generally at 10 in FIGS. 1 and 5-25. This form of the invention comprises a support frame 11 having two walls or panels 12 and 13 joined along one edge to a narrow corner strip 14 at the back corner of the frame and diverging outwardly from the strip perpendicular to one another. The outer edge of each panel is folded to define a tubular reinforced edge 15 and 16, respectively, having a triangular shape in transverse cross section. As seen best in FIGS. 18-21, a plurality of openings 17 are formed through the corner strip spaced along its length, and a corresponding number of openings 18 are formed in the inwardly facing surfaces of the reinforced edges 15 and 16. Rectangularly shaped shelves 20 have a rear corner engaged in respective openings 17 in the corner strip, and opposite side corners engaged in respective openings 18 in the reinforced edges. As shown in the drawings, double face tape 21 (see FIGS. 18-23) is strategically placed between the shelves and support frame to secure the parts together. Alternatively, a suitable adhesive or other fastening means, not shown, could be used.

Adhesive, for example, could be applied in generally the same places as the double face tape shown in the drawings. A base member B preferably is attached to the underside of the bottom shelf, as seen best in FIGS. 24 and 25.

The shelves 20 are a reinforced two-part construction comprising a diagonally extending center brace 30 and an outer wrap 40, each made of a single piece of corrugated paper folded as described hereinafter.

The construction of the brace is shown in FIGS. 6-10 and comprises a top panel 31 shaped with converging angled end edges 32*a* and 32*b* defining opposite pointed ends 32*c* and 32*d*, first narrow side panels 33*a* and 33*b* foldably joined along opposite sides of the top panel 31, bottom panels 34*a* and 34*b* foldably joined to respective side panels 33*a* and 33*b* and having outwardly divergent end edges 35*a* and 35*b* angled oppositely to the end edges 32*a* and 32*b* on the top panel 31, and insert flanges 36*a* and 36*b* foldably joined to respective bottom panels 34*a* and 34*b*. Transverse first slots 37*a* and 37*b* are formed across the bottom panels 34*a* and 34*b* and part way into the side panels and insert flanges, and second slots 38 are formed adjacent and parallel to opposite end edges of each of the bottom panels, both for a purpose described hereinafter. Cuts are made across the juncture between the bottom panels and insert flanges approximately midway between the slots 37*a*, 37*b* and the opposite end edges of the insert flanges, defining openings 39*a* and locking tabs 39*b*, also for a purpose described hereinafter.

The wrap 40 comprises a rectangular top wall 41 having narrow side walls 42*a*, 42*b*, 42*c* and 42*d* foldably joined to its respective edges, first and second triangularly shaped bottom wall panels 43*a* and 43*b* foldably joined to respective opposite side walls 42*a* and 42*c*, narrow insert flanges 44*a* and 44*b* foldably joined to the hypotenuse (angled edges) of the respective first and second triangularly shaped bottom wall panels, elongate narrow tabs 45*a*, 45*b*, 45*c* and 45*d* foldably joined to opposite ends of respective side walls 42*a*-42*d*, and first and second bottom flaps 46*a* and 46*b* foldably joined to side walls 42*b* and 42*d*, respectively. Third slots 47 are formed in the triangular bottom wall panels 43*a* and 43*b* near their folded connection with the side walls 42*a* and 42*c*, and fourth slots 48 are formed in the bottom flaps 46*a* and 46*b* near their folded connection with side walls 42*b* and 42*d*, respectively. Fifth slots 49 are formed in each triangular bottom wall panel 43*a*, 43*b* near their edge that extends perpendicular to the top wall 41, and sixth slots 50 are formed in each bottom flap 46*a* and 46*b* near their opposite side edges. The third, fourth and sixth slots define first graphics attaching slots, as described hereinafter. Seventh slots or cuts 51 defining narrow tabs 52 are formed in two adjacent side walls 42*c* and 42*d* adjacent their folded connection with the top wall 41, and three spaced notches 53 are formed in the free edge of each insert flange 44*a* and 44*b*. Locating marks 41A and 41B preferably are provided on the top wall panel 41 to aid in proper positioning of the brace 30.

Figure 7:
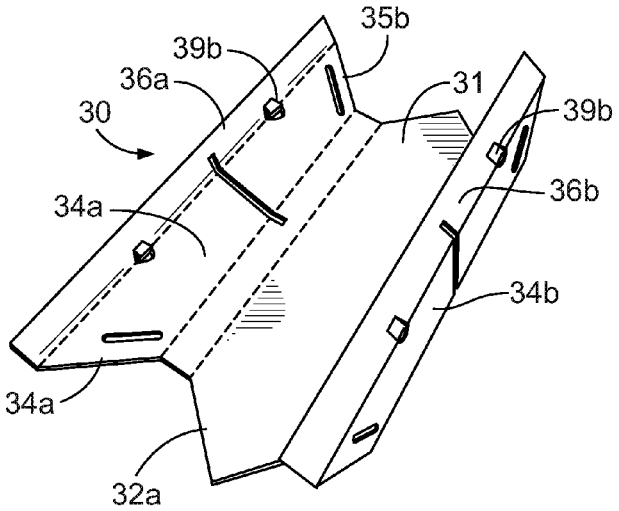
FIGS. 7-10 depict various steps in erecting the reinforcing brace.
Figure 8:
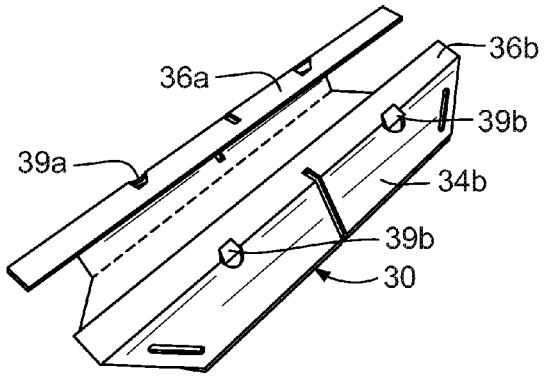
Figure 9:
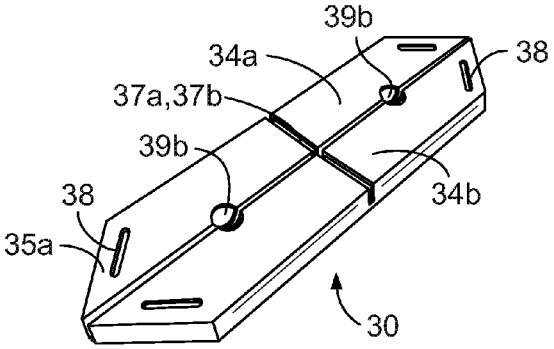
Figure 10:
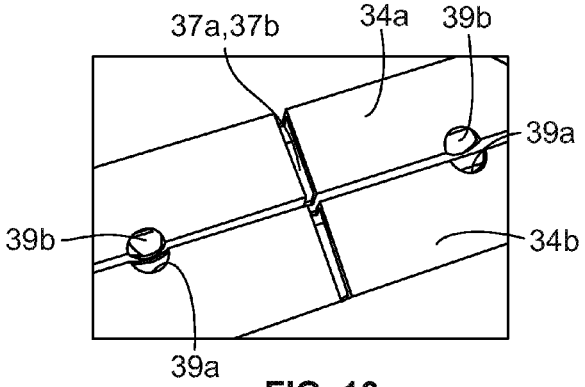
Figure 11:
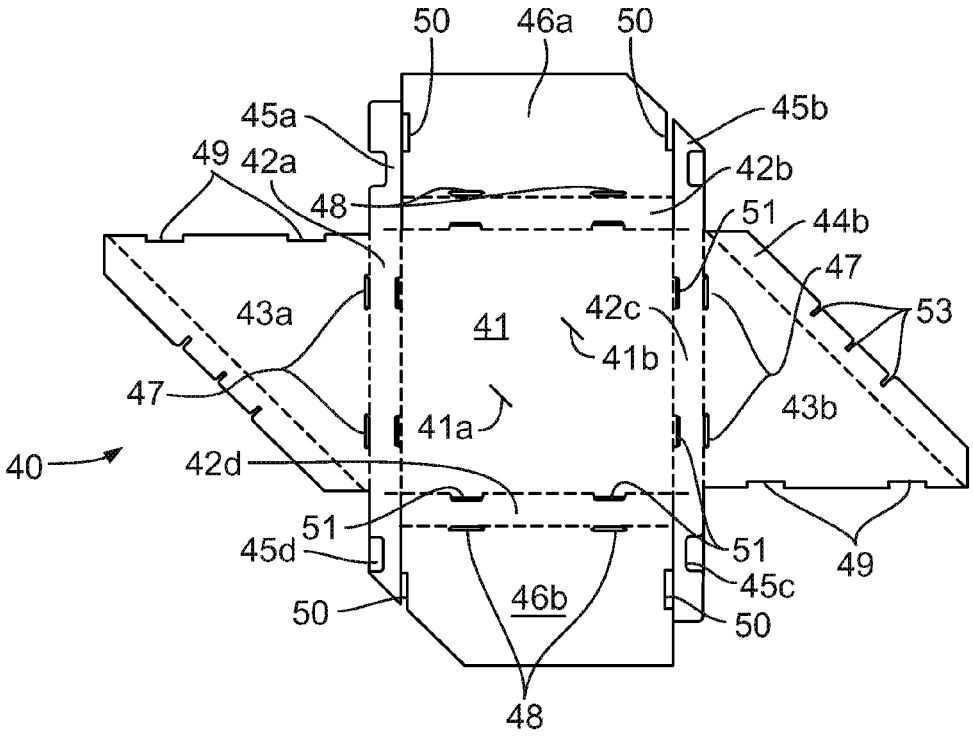
FIG. 11 is a plan view of a blank for making the wrap that is folded around the brace of FIGS. 6-10 to make the reinforced shelves of the invention.

It is preferred that the brace 30 is folded and glued by the manufacturer, but it could be folded into operative condition by a retailer or other user. The steps of erecting the brace into its usable condition are shown in FIGS. 7-10. Initial steps in folding the blank for making the brace are seen in FIG. 7, wherein one of the bottom panels 34*b* is shown partly folded upwardly and inwardly toward the top panel 31. FIG. 8 shows both bottom panels 34*a* and 34*b* folded upwardly and inwardly toward one another over the top panel 31, and FIG. 9 shows the bottom panels folded fully inwardly with the insert flanges 36*a* and 36*b* folded downwardly into parallel contiguous relationship with one another. As shown in FIG. 10, the locking tabs 39*b* on one insert flange are pressed through the openings 39*a* in the opposite insert flange to hold the brace in the assembled condition shown, with the bottom panels 34*a* and 34*b* forming a bottom spaced from and parallel to the top panel 31, wherein said top panel, bottom, and side panels form a tubular structure. If the brace is assembled by the manufacturer, adhesive (not shown) could be used in lieu of the openings 39*a* and locking tabs 39*b*.

It is preferred that the shelves be folded and glued by the manufacturer and shipped to a point of sale or other destination in condition ready to use with the support frame 11 which is shipped flat as shown in FIG. 20, but the steps of assembling a shelf according to the invention are shown in FIGS. 11-17. If desired, all of the components could be shipped flat to a user who would then erect the components and assemble the display rack.

Figure 12:
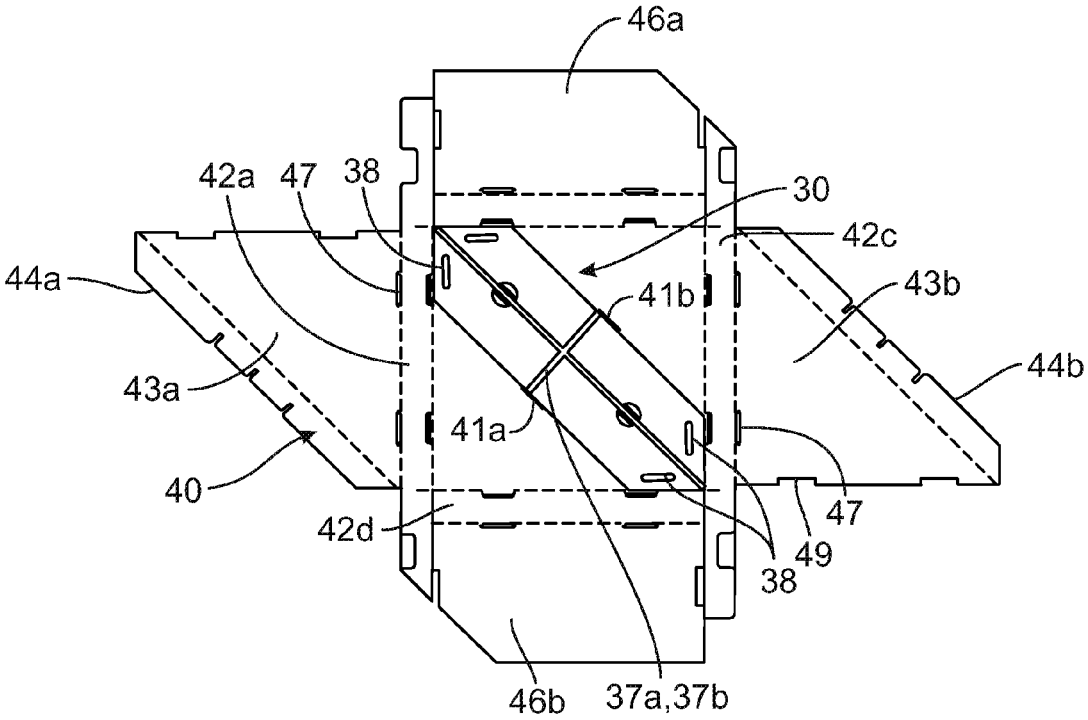
FIGS. 12-16 depict the various steps in erecting a shelf according to the invention.
Figure 13:
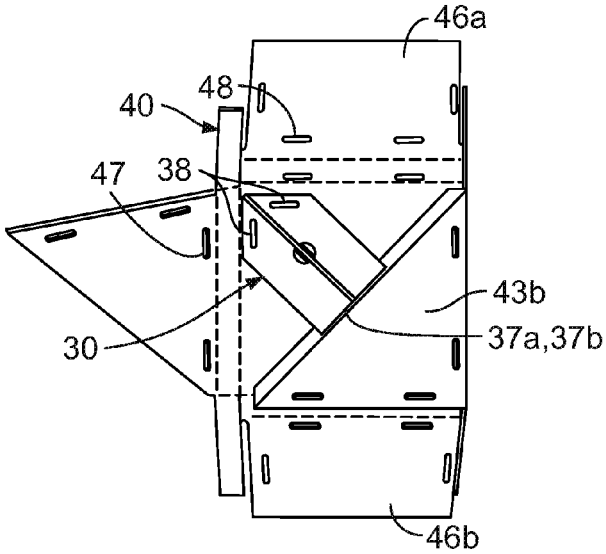
Figure 14:
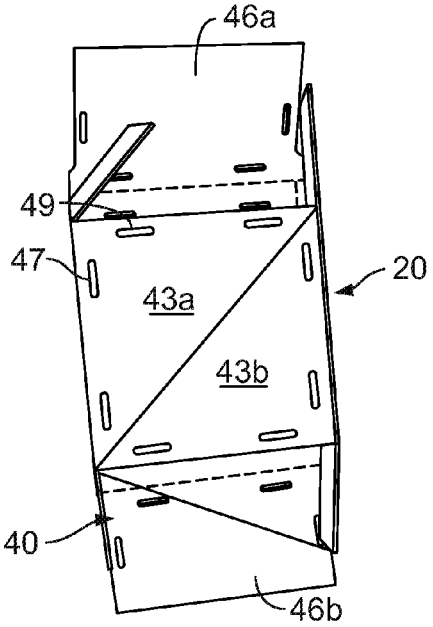
Figure 15:
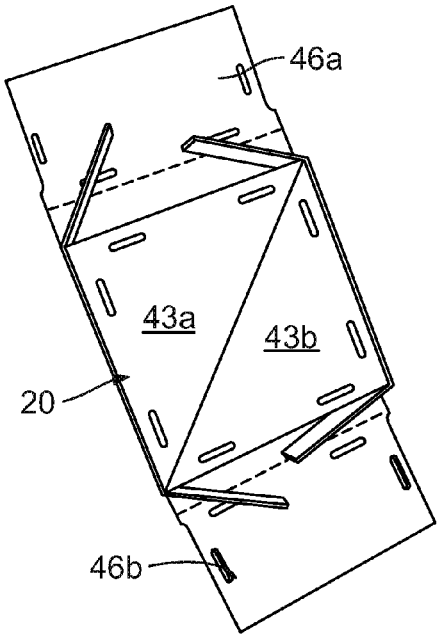
Figure 16:
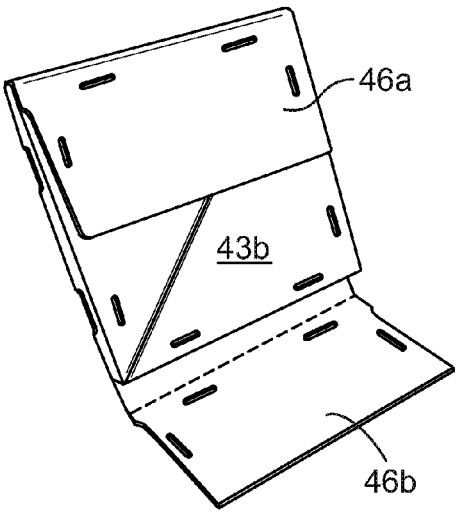
Figure 17:
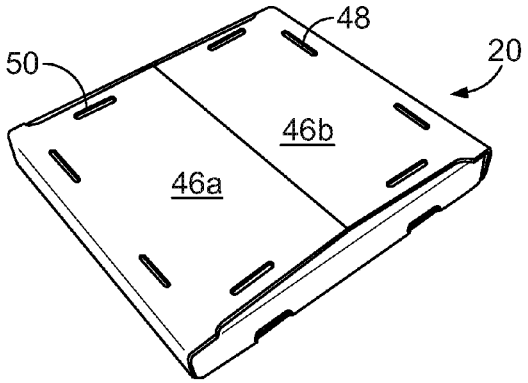
FIG. 17 is an isometric view looking toward the bottom of a completed shelf.

As shown in FIG. 12, the brace 30 is placed on the top wall 41 of the wrap, with its sides parallel to the angled edges of the bottom wall panels 43*a* and 43*b* and its opposite pointed ends lying in opposite corners of the top wall. The bottom wall panels are then folded inwardly as shown in FIGS. 13 and 14, with the notched insert flanges 44*a* and 44*b* on the angled edges of the bottom wall panels inserted into the slots 37*a* and 37*b* in the bottom of the brace. The notches 52 in the free edge of each insert flange on the wrap receive the upper edges of the brace side panels and insert flanges located below the slots 37*a*, 37*b* in the erected brace as shown in FIG. 10. The narrow tabs 45*a*, 45*b*, 45*c* and 45*d* are then folded inwardly to extend across the open ends of the brace, followed by inward folding of the first and second bottom flaps 46*a* and 46*b* as shown in FIGS. 15 and 16, to form the finished shelf 20 as shown in FIG. 17.

Figure 18:
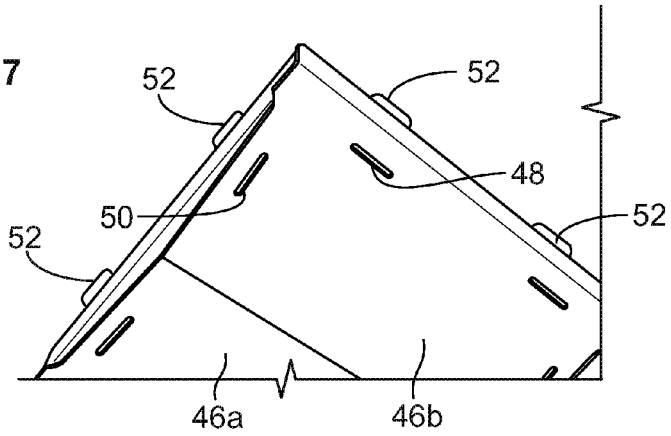
FIG. 18 is a slightly enlarged fragmentary view of the bottom of one corner of the shelf of the invention, showing tabs projecting from two adjacent edges.
Figure 19:
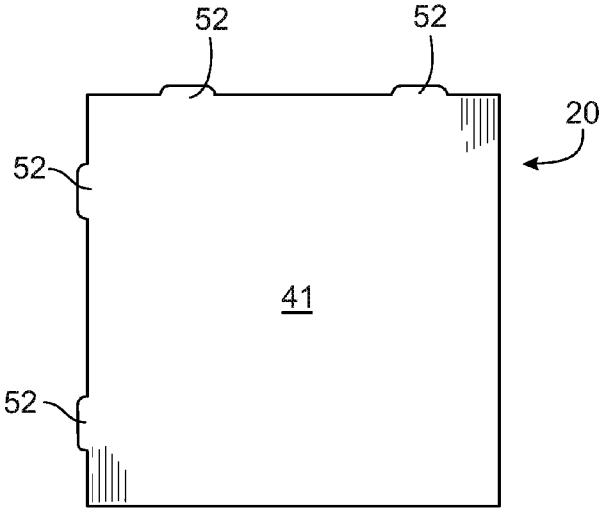
FIG. 19 is a top plan view of the shelf of FIG. 18, showing the tabs projecting coplanar with the top surface of the shelf.

As seen in FIGS. 18 and 19, the narrow tabs 52 defined by cuts 51 in two adjacent side walls 42*c* and 42*d* project outwardly from adjacent side edges of the shelf for cooperation with slots in the support frame 11 as described hereinafter.

Figure 20A:
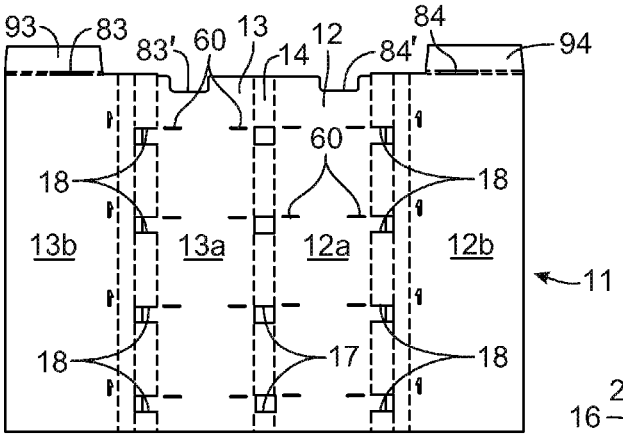
FIG. 20A is a plan view of a blank for making the support frame of the invention.
Figure 20B:
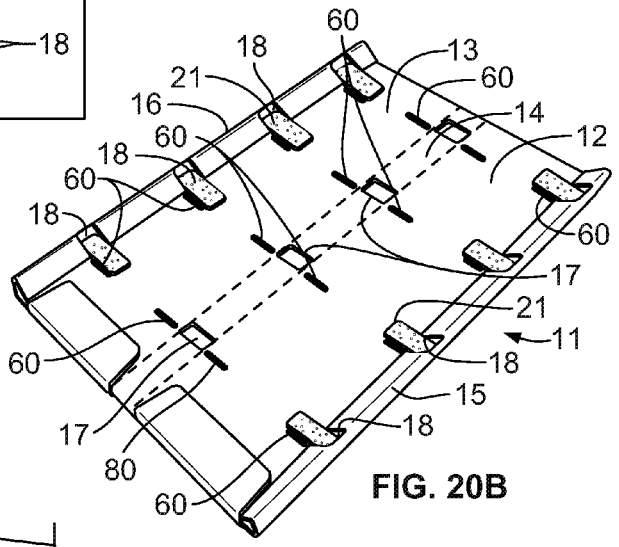
FIG. 20B is an isometric view looking from the top end of an assembled support frame of the invention, prior to attachment of shelves.
Figure 21:
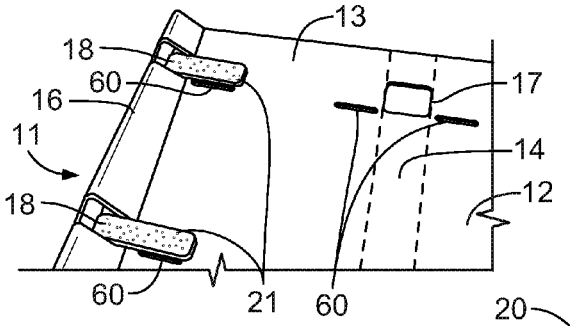
FIG. 21 is an enlarged fragmentary view of one corner of the blank of FIG. 18.
Figure 22:
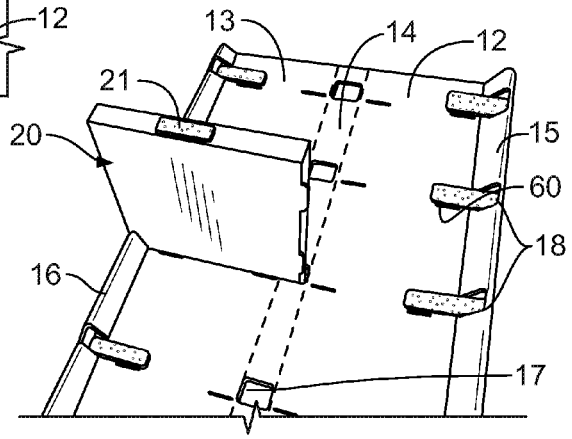
FIGS. 22-25 depict steps in assembling the display rack of the invention.
Figure 23:
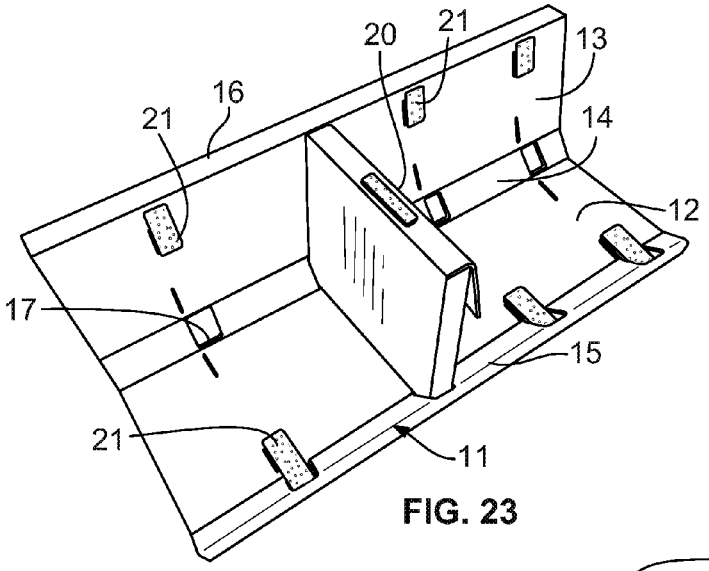

As previously briefly described above, the support frame 11, which is shipped to the user in the flattened condition shown in FIG. 20B, has two side walls or panels 12 and 13 joined along one edge to a narrow strip 14, with the outer edges of the side walls folded to define tubular reinforced edges 15 and 16, respectively, having a triangular shape in transverse cross section. As seen best in FIG. 20A, the side walls 12 and 13 have a double thickness formed by back panels 12B and 13B, respectively, folded and glued behind associated front panels 12A and 13A, respectively. A flap 94 on the top edge of panel 12B is folded over and glued to the front of panel 12A, and a flap 93 on the top edge of panel 13B is folded over and glued to the front of panel 13A. Slots 83 and 84 at the folded juncture of the flaps 94 and 93 with their associated panels 13B and 12B, and notches 84' and 83' are formed in respective top edges of walls 12 and 13 to receive tabs on a header panel as described hereinafter. A plurality of openings 17 are formed through the strip 14 spaced along its length, and a corresponding number of openings 18 are formed in the inwardly facing surfaces of the reinforced edges 15 and 16 in transverse alignment with the openings 17. Shelf attaching slots 60 are made through each side panel 12, 13 adjacent each side edge thereof in transverse alignment with the top edges of the openings 17 and 18, and double face tape 21 is placed on each side panel adjacent and in alignment with the openings 18 in the reinforced edges 15, 16.

To assemble the shelves 20 to the support frame 11, as shown in FIGS. 22-25, typically accomplished by the end user, the frame 11 is placed on its back on a support surface and the shelves are positioned edgewise on the frame with one corner of each shelf in registry with a respective opening 17 in the corner strip 14 and an opposite corner engaged in an opening 18 in the adjacent reinforced edge 15 (or 16, depending on which side of the frame the shelves are first placed). The narrow tabs 52 projecting outwardly from one side edge of each shelf extend into respective shelf attaching slots 60 in the side panel 12 or 13 on which the shelf has been placed. The opposite side panel 12 (or 13) is then folded upwardly around the shelves so that the corner of each shelf adjacent the narrow corner strip 14 extends into a respective opening 17 in the corner strip and the corner adjacent the upwardly folded side panel 12 (or 13) extends into a respective opening 18 in the reinforced edge 15 (or 16). The tabs 52 on the other side edge of each shelf extend into the slots 60 in the upwardly folded side panel 12 (or 13). The protective paper is peeled off the double face tape 21 prior to placement of the shelves on the frame so that the tape in combination with the tabs and slots holds the shelf and frame assembly together.

Figure 24:
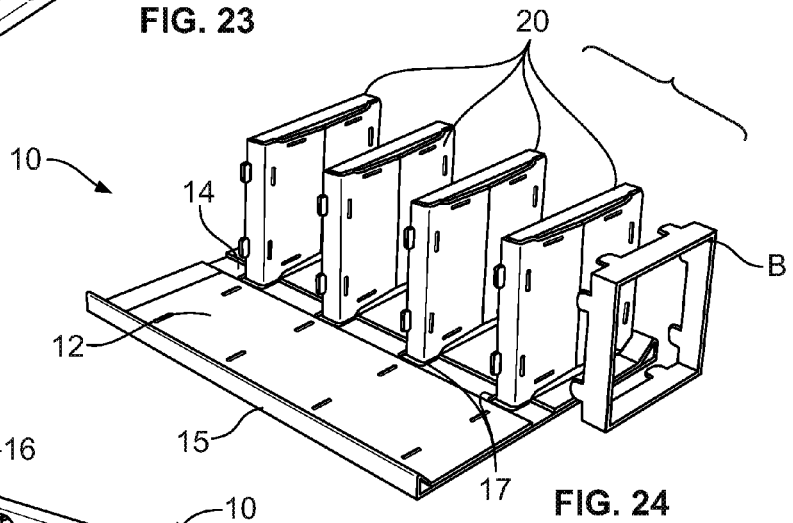
Figure 25:
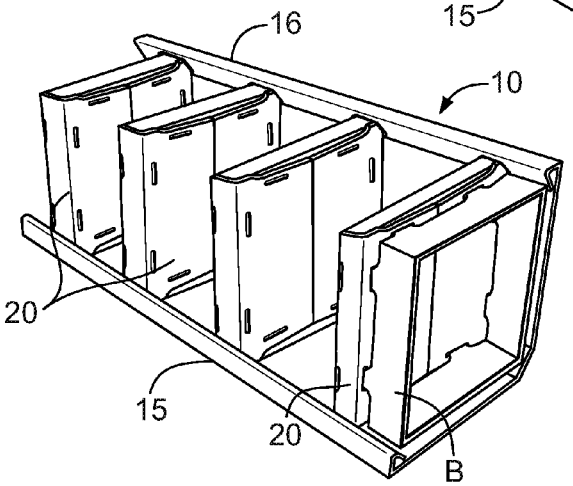

As seen best in FIGS. 24 and 25, the base member B is attached to the underside of the bottom shelf. The base member rests on the surface on which the display rack is supported.

Figure 26:
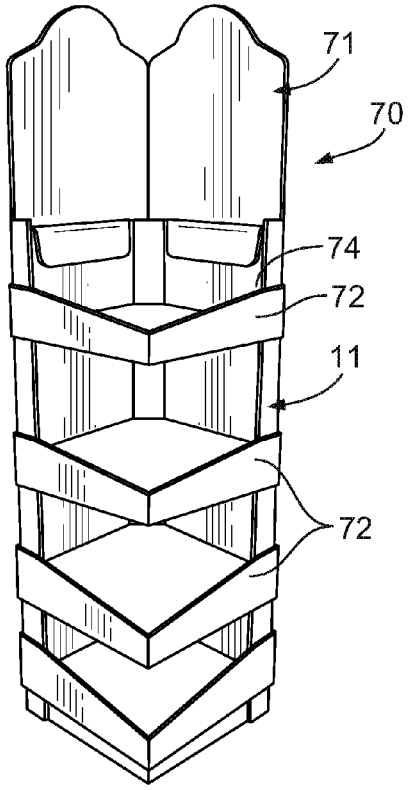
FIG. 26 is a view from the front of an optional embodiment of the invention wherein a graphics display header is attached to the top of the rack.
Figure 28:
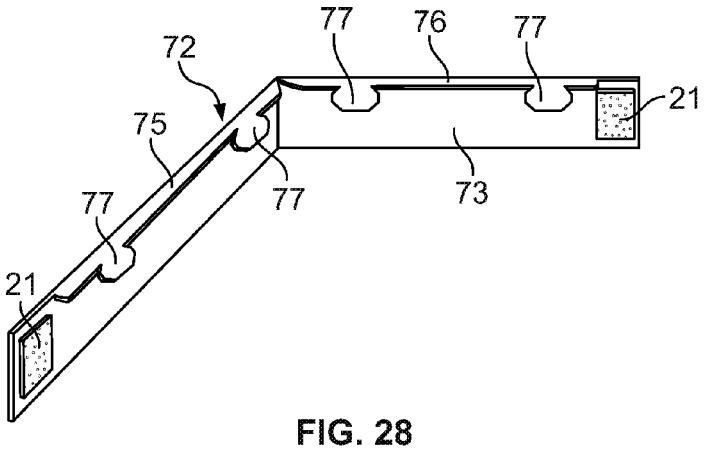
FIG. 28 is a bottom isometric view of one form of graphics shelf skirt that may be applied to the shelves.

An optional alternate embodiment is indicated generally at 70 in FIG. 26. In this embodiment, a graphics header 71 is attached to the top of the support frame 11, and graphics skirts 72 are attached to the exposed edges of the shelves. Details of the skirts 72 are seen best in FIG. 28, wherein the skirt is shown inverted. The skirts 72 each comprise side panels 73 that are oriented vertically when in use and may have a shaped top edge 74. Narrow bottom flanges 75 and 76 are on the bottom edges of the side panels and shaped locking tabs 77 are on the free edges of the flanges. Double face tape 21 is placed on extended ends 78 of the side panels. To install the skirts, the panels 73 are placed against the exposed edges of a shelf 20, the flanges 75 and 76 bent rearwardly beneath the shelf, and the tabs 77 inserted upwardly through the slots 50 and into slots 47 or 48 in the bottom of the shelf. The extended ends 78 of the skirts are attached to the sides of the frame by use of the double face tape 21.

Figure 3:
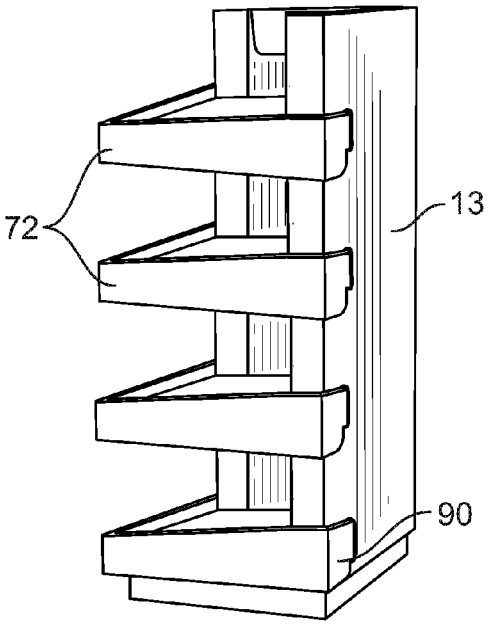
FIG. 3 is a side view of the embodiment of display rack shown in FIG. 2.
Figure 4:
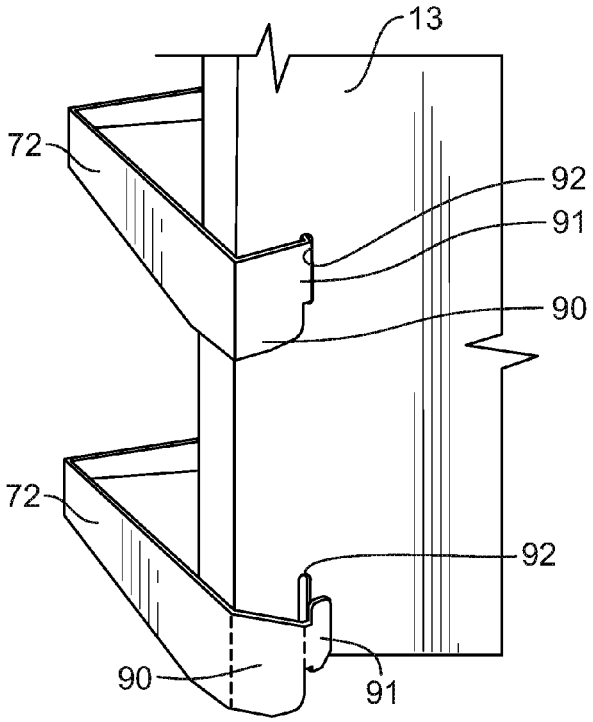
FIG. 4 is an enlarged fragmentary view of the rack of FIG. 2, looking at a slight angle from the back toward the outside of one corner of the rack.
Figure 5:
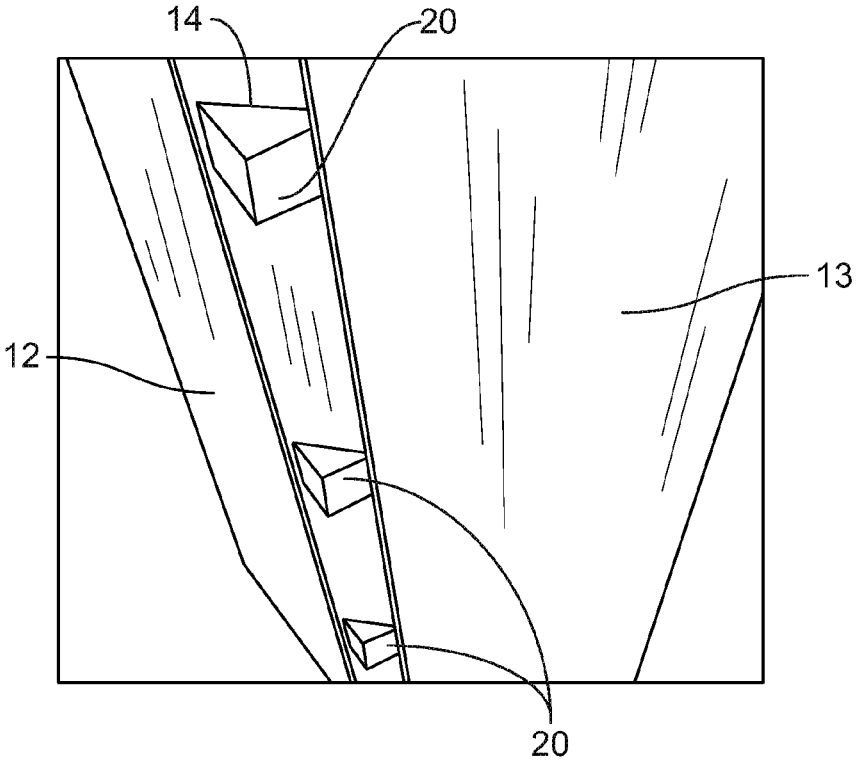
FIG. 5 is an enlarged fragmentary view of the rack FIGS. 1 and 2 looking at a slight angle toward the outside of the back corner of the rack, showing how the rear corner of the shelves extend through the opening in the narrow strip at the back corner of the support frame.
Figure 6:
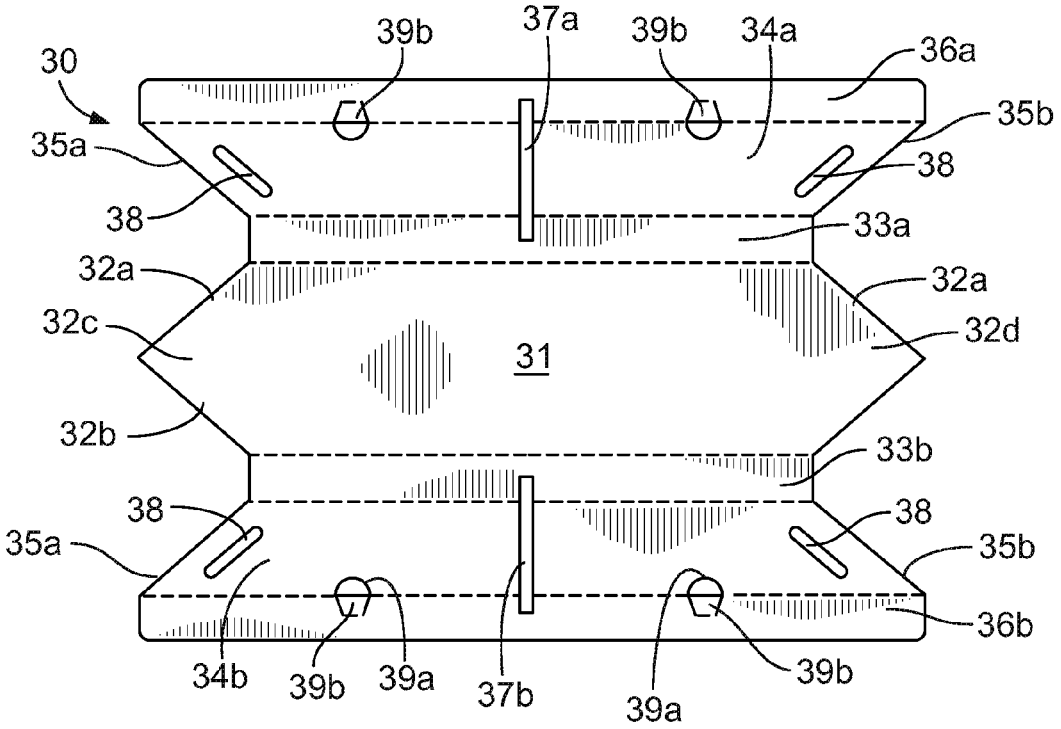
FIG. 6 is a plan view of a blank for making the reinforcing brace used in the shelves of the invention.

Alternatively, as shown in FIGS. 3 and 4, the extended ends 78 wrap around the corners of the support frame 11 and tuck into slots on the back of the frame.

Figure 27:
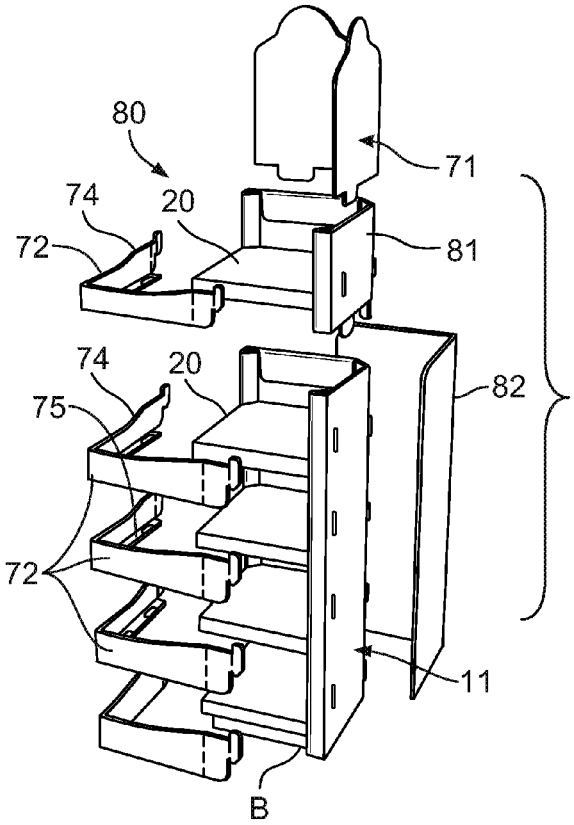
FIG. 27 is an isometric exploded view of a further embodiment wherein a fifth shelf extension is provided for insertion between the top of the display rack of FIG. 2 and the graphics header of FIG. 26.

FIG. 27 shows a further optional embodiment 80 in which an extension piece 81 and fifth shelf 20 are assembled to the top of the support frame 11, and a graphics wrap 82 is attached to the back of the support frame. When the extension piece is used, the graphics header 71 is attached to the extension piece in the same way it would be attached to the support frame 11. In this regard, reference is made to FIGS. 29-31.

Figure 29:
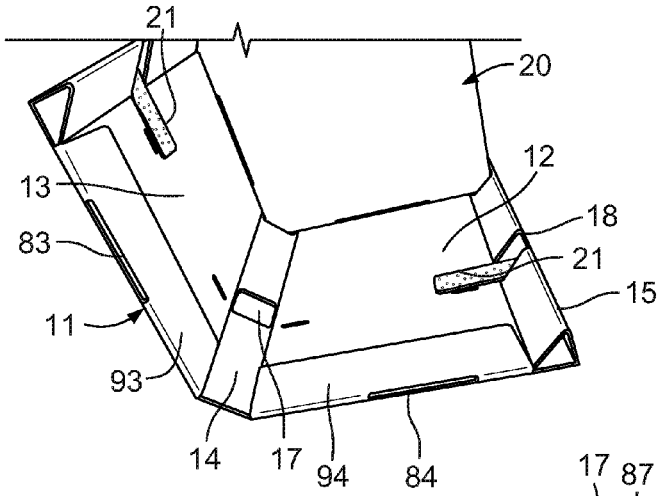
FIG. 29 is a slightly enlarged fragmentary end view looking toward the top of the display rack, showing the slots for receiving tabs on the graphics header or fifth shelf extension to attach the extension to the rack.
Figure 30:
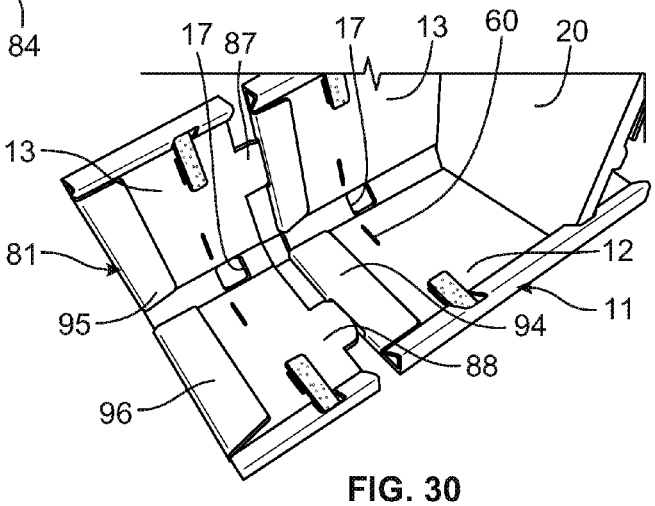
FIG. 30 shows the extension being assembled to the stand.
Figure 31:
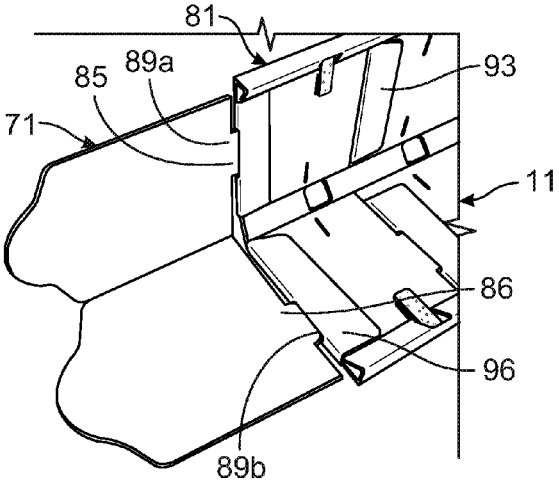
FIG. 31 shows the graphics header of FIG. 27 being applied to the extension.

FIG. 29 is an end view of the support frame 11 and shows second graphics attaching slots 83 and 84 in the upper end of the support frame for receiving tabs 85 and 86 on the bottom edge of the graphics header 71 or, as depicted in FIG. 30, the tabs 87 and 88 on the bottom of the extension piece 81. The extension piece has corresponding third graphics attaching slots 89*a* and 89*b* for receiving the tabs on the graphics header, as depicted in FIG. 31. In the example shown and described herein, and with particular reference to FIGS. 29-31, flaps 93 and 94 on the upper end of the support frame are folded over and glued to the walls 12 and 13, defining a space between the flaps and walls. The slots 83 and 84 open into this space, which provides room for insertion of the tabs 85 and 86 on the lower end of the graphics header 71 or the tabs 87 and 88 on the lower end of the extension piece. Similarly, flaps 95 and 96 are folded and glued on the upper end of the extension piece 81 to provide space for insertion of the tabs 85 and 86 on the lower end of the graphics header 71.

Figure 32:
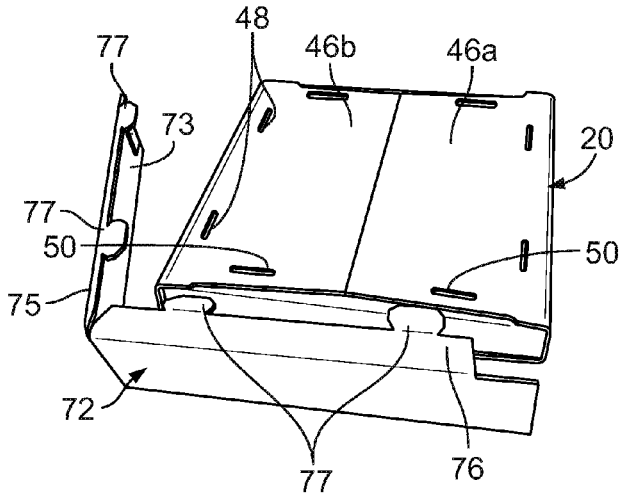
FIGS. 32-34 depict the steps in assembling the graphics skirt to a shelf.
Figure 33:
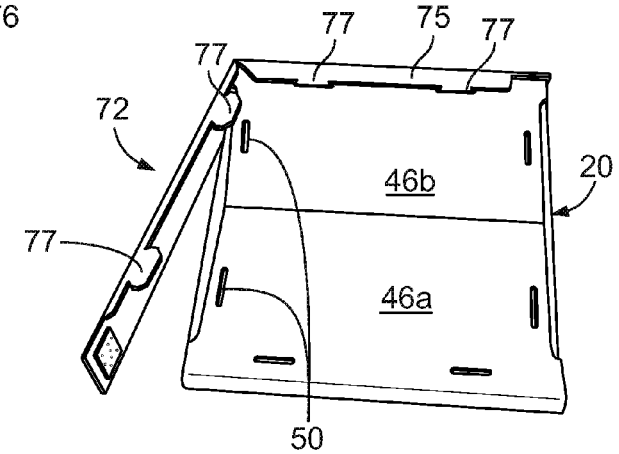
Figure 34:
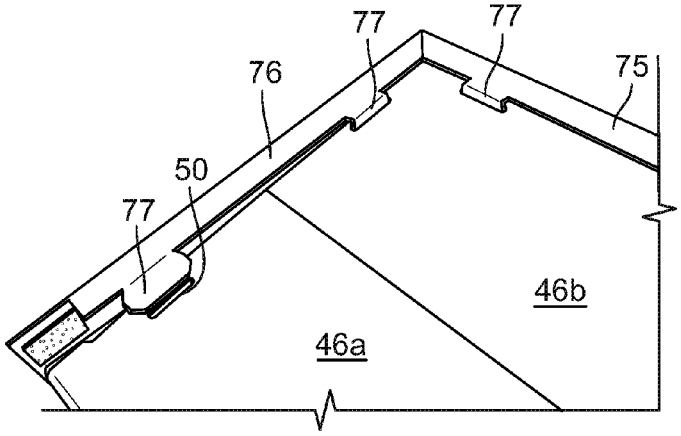

One method of assembly of the graphics skirts 72 to the shelves 20 is shown in FIGS. 32-34. In the method shown in these figures the skirt is attached to the shelf by the use of double face tape 21 and insertion of tabs 73 on the free edge of skirt bottom flanges 74 and 75 through the slots 48 and 50 in adjacent edges of the bottom flaps 46*a* and 46*b* and into the aligned slots 47 (not seen in these figures) in the underlying triangular bottom wall panels 43*a* and 43*b*.

Figure 2:
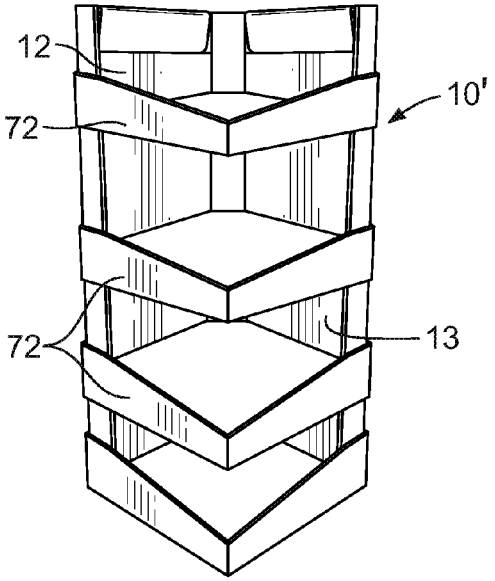
FIG. 2 is a front isometric view of the first embodiment of display rack with graphic panels applied to the shelves.

When the shelves are made by the manufacturer, the skirts are glued to the shelves and an extended rearward end 90 on each skirt is wrapped around the corner of the support frame and a tab 91 on end 90 is inserted into a respective slot 92 in the adjacent side panels 12 and 13, respectively, of the support frame 11. FIGS. 2-4 depict this arrangement.

The display rack of the invention is economical to make and use and is fully recyclable. The structure allows for additional product visibility and additional shopper interest, both core criteria in measuring a display's in-store effectiveness. The cantilevered mounting of the shelves provides an exceptionally strong structure, wherein each shelf is easily capable of supporting over 45 lbs of product without appreciable sagging or distress. This strength comes from the insertion of three corners of each shelf into an extended wedge in the vertical wall and the provision of a brace extending in the shelf from the rear corner to the front corner. In this regard, it is noted that the rearward ends of the braces extend into the openings 17, whereby the brace acts as a cantilevered beam.

While particular embodiments of the invention have been illustrated and described in detail herein, it should be understood that various changes and modifications may be made in the invention without departing from the spirit and intent of the invention as defined by the appended claims.

What is claimed is:

1. A display rack for supporting and displaying articles, comprising:

a support frame having two walls, said walls extending at an angle to one another from a narrow strip at a rear corner of the frame and each having a forward free edge with a tubular reinforcing structure along its length; and a plurality of shelves supported on said support frame between said walls, said shelves each having first support means engaging said strip and second support means engaging a respective said reinforcing structure so that a forward portion of the shelves projects forwardly of the support frame for greater visibility of and access to articles supported on the shelves wherein the shelves are rectangular in shape, having opposite side edges, a rear corner, a front corner and opposite side corners;

said strip and said reinforcing structures have a plurality of openings spaced along their length;

said first support means comprises said rear corners of the shelves and said second support means comprises said side corners of the shelves, said rear corners being engaged in respective said openings in the strip and the side corners being engaged in respective said openings in the reinforcing structures; and a reinforcing brace extends diagonally from the rear corner of each shelf to the front corner thereof.

2. A display rack as claimed in claim 1, wherein:

the support frame and shelves are made of recyclable corrugated paper material.

3. A display rack as claimed in claim 1, wherein:

the support frame and shelves are made of recyclable corrugated paper material; said shelves have two forward side edges exposed beyond the free edges of said walls of the support frame; and graphics display skirts are attached to said shelves in covering relationship to said forward side edges.

4. A display rack as claimed in claim 1, wherein:

the support frame and shelves are made of recyclable corrugated paper material; said shelves have two forward side edges exposed beyond the free edges of said walls of the support frame;

graphics display skirts are attached to said shelves in covering relationship to said forward side edges;

first graphics attaching slots are formed in an underside of said shelves adjacent said forward side edges; and tabs on a bottom edge of said graphics display skirts are inserted into said first graphics attaching slots.

5. A display rack as claimed in claim 1, wherein:

said support frame has an upper end and a lower end; and a separate extension of said support frame, comprising extensions of said walls of the frame and an additional shelf, are attached to said support frame upper end.

6. A display rack as claimed in claim 1, wherein:

said support frame has an upper end and a lower end;

a separate extension of said support frame, comprising extensions of said walls of the support frame and an additional shelf, are attached to said support frame upper end;

second graphics attaching slots are formed in said frame upper end; and said separate extension has tabs on a lower end thereof received in said second graphic attaching slots to attach said separate extension to said support frame.

7. A display rack as claimed in claim 1, wherein:

the support frame and shelves are made of recyclable corrugated paper material;

said shelves have two forward side edges exposed beyond the free edges of said support frame walls;

graphics display skirts are attached to said shelves in covering relationship to said forward side edges; and said graphics display skirts are adhered to said shelf forward edges and have an extended rearward end wrapped around a side corner of said support frame, said extended ends being engaged in respective slots in a rear surface of said support frame.

8. A display rack for supporting and displaying articles, comprising:

a support frame having two side walls extending at an angle to one another from a narrow strip at a rear corner of the support frame, wherein each side wall has a forward free edge along its length, and said narrow strip and said forward free edges each have a plurality of openings spaced along their length; and a plurality of shelves supported on the side walls of the support frame, wherein each of the shelves is rectangular in shape and has a rear corner, a front corner, opposite side corners, spaced apart parallel top and bottom walls, first and second side edges extending perpendicular to one another from said shelf rear corner and defining shelf rearward side edges, third and fourth side edges joined to respective said first and second side edges and extending perpendicular to one another from said shelf front corner and defining shelf forward side edges, and a reinforcing brace between the top and bottom walls extending diagonally from the rear corner of the shelf to the front corner thereof, said rear corners of the shelves being engaged in respective said openings in the strip and the side corners of the shelves being engaged in respective said openings in the forward free edges of the support frame so that the shelves are cantilevered from the support frame with the forward side edges thereof projecting forwardly of the forward free edges of the support frame side walls.

9. A display rack as claimed in claim 8, wherein:

said shelf rearward side edges have outwardly projecting tabs thereon; and said support frame side walls have slots formed therein, said outwardly projecting tabs on said shelf rearward side edges being engaged in said slots.

10. A display rack as claimed in claim 8, wherein:

said shelf rearward side edges have outwardly projecting tabs thereon;

said support frame side walls have slots formed therein, said outwardly projecting tabs on said shelf rearward side edges being engaged in said slots; and a rearward end of each said reinforcing brace extends into a respective said opening in said narrow strip.

11. A display rack as claimed in claim 8, wherein:

said shelf rearward side edges have outwardly projecting tabs thereon;

said support frame side walls have slots formed therein and said outwardly projecting tabs on said shelf rearward side edges are engaged in said slots;

said shelves each comprise a wrap forming said top and bottom walls and said rearward and forward side edges; and said wrap and said reinforcing brace are formed of separate pieces of corrugated paper material folded and assembled to one another to construct a said shelf.

12. A display rack as claimed in claim 8, wherein:

said shelf rearward side edges have outwardly projecting tabs thereon;

said support frame side walls have slots formed therein and said outwardly projecting tabs on said shelf rearward side edges are engaged in said slots; and said shelves each comprise a wrap forming said top and bottom walls and said rearward and forward side edges, said wrap and said reinforcing brace each being formed of a separate piece of corrugated paper material folded and assembled to one another to construct a said shelf, wherein said brace has a bottom, opposed side panels, a top panel spaced from and parallel to said bottom, and opposite pointed ends.

13. A display rack for supporting and displaying articles, comprising:

a support frame made of paper material and having only two walls, said walls extending at an angle to one another from a narrow strip at a rear corner of the frame and each having a forward free edge;

a plurality of openings spaced along said narrow strip and said forward free edges; and a plurality of shelves made of paper material supported on said support frame between said walls, said shelves being rectangular in shape with rearward side edges, forward side edges, a rear corner, a front corner, and opposite side corners, said rearward side edges lying against said walls of said support frame, wherein said rear corner of each said shelf extends into a respective one of said openings in said narrow strip and said side corners of each said shelf extend into a respective one of said openings in said forward free edges of said support frame, so that said forward side edges of the shelves project forwardly of the forward free edges of the support frame for greater visibility of and access to articles supported on the shelves and wherein a reinforcing brace extends diagonally from the rear corner of each shelf to the front corner thereof.

* * * * *